US009616561B2

(12) United States Patent
Liu et al.

(10) Patent No.: US 9,616,561 B2
(45) Date of Patent: Apr. 11, 2017

(54) NAIL GUN HAVING A DRY FIRING PREVENTION DEVICE

(71) Applicant: BASSO INDUSTRY CORP., Taichung (TW)

(72) Inventors: An-Gi Liu, Taichung (TW); Guey-Horng Liou, Taichung (TW); Wen-Cheng Lo, Taichung (TW)

(73) Assignee: BASSO INDUSTRY CORP., Taichung (TW)

( * ) Notice: Subject to any disclaimer, the term of this patent is extended or adjusted under 35 U.S.C. 154(b) by 396 days.

(21) Appl. No.: 14/507,164

(22) Filed: Oct. 6, 2014

(65) Prior Publication Data

US 2015/0097015 A1 Apr. 9, 2015

(30) Foreign Application Priority Data

Oct. 7, 2013 (TW) ..... 102136187 A

(51) Int. Cl.
*B25C 1/04* (2006.01)
*B25C 1/00* (2006.01)

(52) U.S. Cl.
CPC ..... *B25C 1/008* (2013.01); *B25C 1/04* (2013.01)

(58) Field of Classification Search
CPC ..... B25C 1/04; B25C 1/008
See application file for complete search history.

(56) References Cited

U.S. PATENT DOCUMENTS 6,966,476 B2 * 11/2005 Jalbert ..... B25C 1/003 227/137
7,134,586 B2 * 11/2006 McGee ..... B25C 1/008 227/120
8,292,143 B2 * 10/2012 Lee ..... B25C 1/008 227/120
8,833,626 B2 * 9/2014 Perron ..... B25C 1/008 227/120
9,221,161 B2 * 12/2015 Miller ..... B25C 1/008
2005/0023323 A1 * 2/2005 Jalbert ..... B25C 1/003 227/137
2007/0125821 A1 * 6/2007 Wang ..... B25C 1/047 227/8
2012/0074194 A1 * 3/2012 Miller ..... B25C 1/04 227/8
2012/0085806 A1 * 4/2012 Lee ..... B25C 1/008 227/8
2014/0252060 A1 * 9/2014 Segura ..... B25C 1/008 227/8

* cited by examiner

*Primary Examiner* — Andrew M Tecco
(74) *Attorney, Agent, or Firm* — Kirton McConkie; Evan R. Witt

(57) ABSTRACT

A nail gun includes a body, a valve unit, a nail striking member and a detector. The body has a nail path, an air chamber, and an intake chamber guiding flow of air into the air chamber. The nail striking member is drivable by air pressure in the air chamber for striking a nail in the nail path. The valve unit is operable to switch between unblocking and blocking states to respectively permit and prevent fluid communication between the intake chamber and the air chamber. The detector is connected pivotally to the body, and is contactable with the valve unit such that, when there is no nail in the nail path, the valve unit is controlled by the detector to be in the blocking state.

9 Claims, 10 Drawing Sheets

NAIL GUN HAVING A DRY FIRING PREVENTION DEVICE

CROSS-REFERENCE TO RELATED APPLICATION

This application claims priority of Taiwanese Application No. 102136187, filed on Oct. 7, 2013.

FIELD OF THE INVENTION

The invention relates to a nail gun, more particularly to a nail gun that is prevented from dry firing.

BACKGROUND OF THE INVENTION

Referring to FIG. 1, U.S. Pat. No. 7,213,735 discloses a conventional nail gun 1 that includes a gun body 11, a magazine 12 and a striking unit 13. The gun body 11 has an air chamber 110, an inlet 111 through which compressed air is fed into the air chamber 110, a valve seat 112 that is disposed in the air chamber 110, and a nail path 113 that is formed in a front portion of the gun body 11. The magazine 12 is connected to the gun body 11 for receiving a row of nails (not shown), and pushes the nails into the nail path 113 one at a time. The striking unit 13 includes a cylinder 131 that is disposed movably in the air chamber 110, a nail-striking member 132 that is movable relative to the cylinder 131, a sealing ring 133 that is connected co-movably to the cylinder 131 for being in sealing contact with the valve seat 112, and an operating button 134 that is connected co-movably to the cylinder 131, and that extends out of the gun body 11.

When the operating button 134 is pressed, the cylinder 131 and the sealing ring 133 are driven to form a gap between the sealing ring 133 and the valve seat 112, such that the compressed air flows through the valve seat 112 to drive the nail-striking member 132 to strike one of the nails that is retained in the nail path 113.

However, the nail-striking member 132 performs the nail-striking operation in response to each depression of the operating button 134 even when there is no nail in the nail path 113. The dry firing of the conventional nail gun 1 may be inconvenient for a user.

SUMMARY OF THE INVENTION

Therefore, the object of the present invention is to provide a nail gun that can overcome the aforesaid drawbacks associated with the prior art.

Accordingly, a nail gun of the present invention includes a body, a magazine, a valve unit, a nail striking member and a detector. The body has a nail path formed in a front end portion thereof, an air chamber, a main flowpath in fluid communication with the air chamber, and an air passage guiding flow of air into the main flowpath. The magazine is connected with the body and includes a magazine body adapted for receiving a plurality of nails, and a nail pushing unit movable between upper and lower limit positions and adapted for pushing and moving the nails into the nail path one at a time. The upper limit position is proximate to the nail path. The lower limit position is distal from the nail path. The valve unit is disposed in the air passage and cooperates with the body to divide the air passage into an intake chamber and an exhaust chamber that is adapted to be in fluid communication with the outside. The valve unit is in fluid communication with the main flowpath and the air passage and is operable to switch between an unblocking state, where fluid communication between the intake chamber and the air chamber is permitted and where fluid communication between the exhaust chamber and the air chamber is prevented, and a blocking state, where the fluid communication between the intake chamber and the air chamber is prevented and where the fluid communication between the exhaust chamber and the air chamber is permitted. The nail striking member is disposed in the nail path and is drivable by air pressure in the air chamber to move along an X-axis for performing a nail striking operation. The detector has a control portion, a detecting portion adapted to be contactable with one of the nail pushing unit and the nails, and an intermediate portion disposed between the control portion and the detecting portion and connected pivotally to the body. The control portion extends into the exhaust chamber and is contactable with the valve unit such that, when there is not any of the nails in the nail path, or when the nail pushing unit is moved to the upper limit position, the valve unit is controlled by the control portion of the detector to be in the blocking state.

BRIEF DESCRIPTION OF THE DRAWINGS

Other features and advantages of the present invention will become apparent in the following detailed description of the embodiments with reference to the accompanying drawings, of which.

DETAILED DESCRIPTION OF THE EMBODIMENTS

Figure 1:
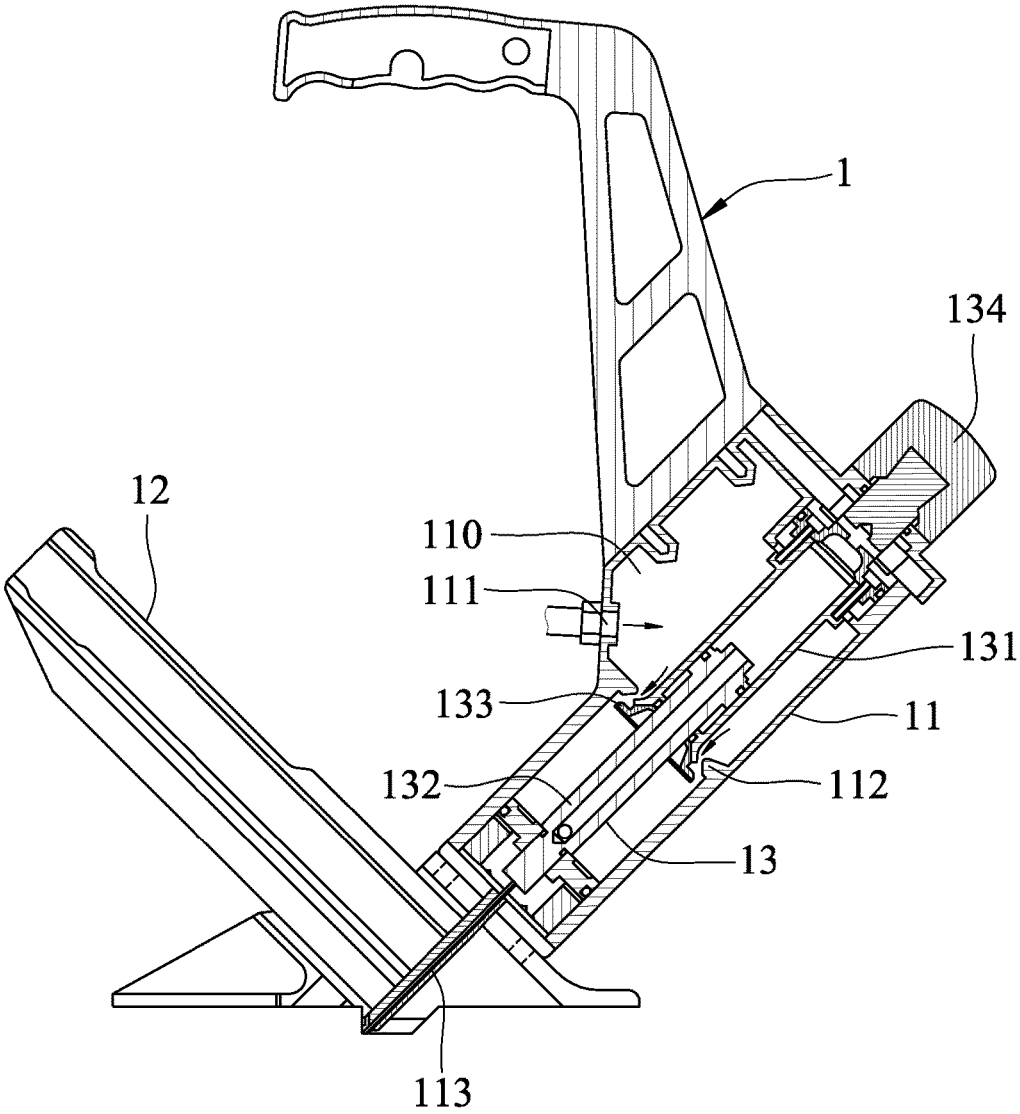
FIG.1 PRIOR ART
FIG. 1 is a partly sectional view of a conventional nail gun disclosed in U.S. Pat. No. 7,213,735.

Before the present invention is described in greater detail, it should be noted that like elements are denoted by the same reference numerals throughout the disclosure.

Figure 2:
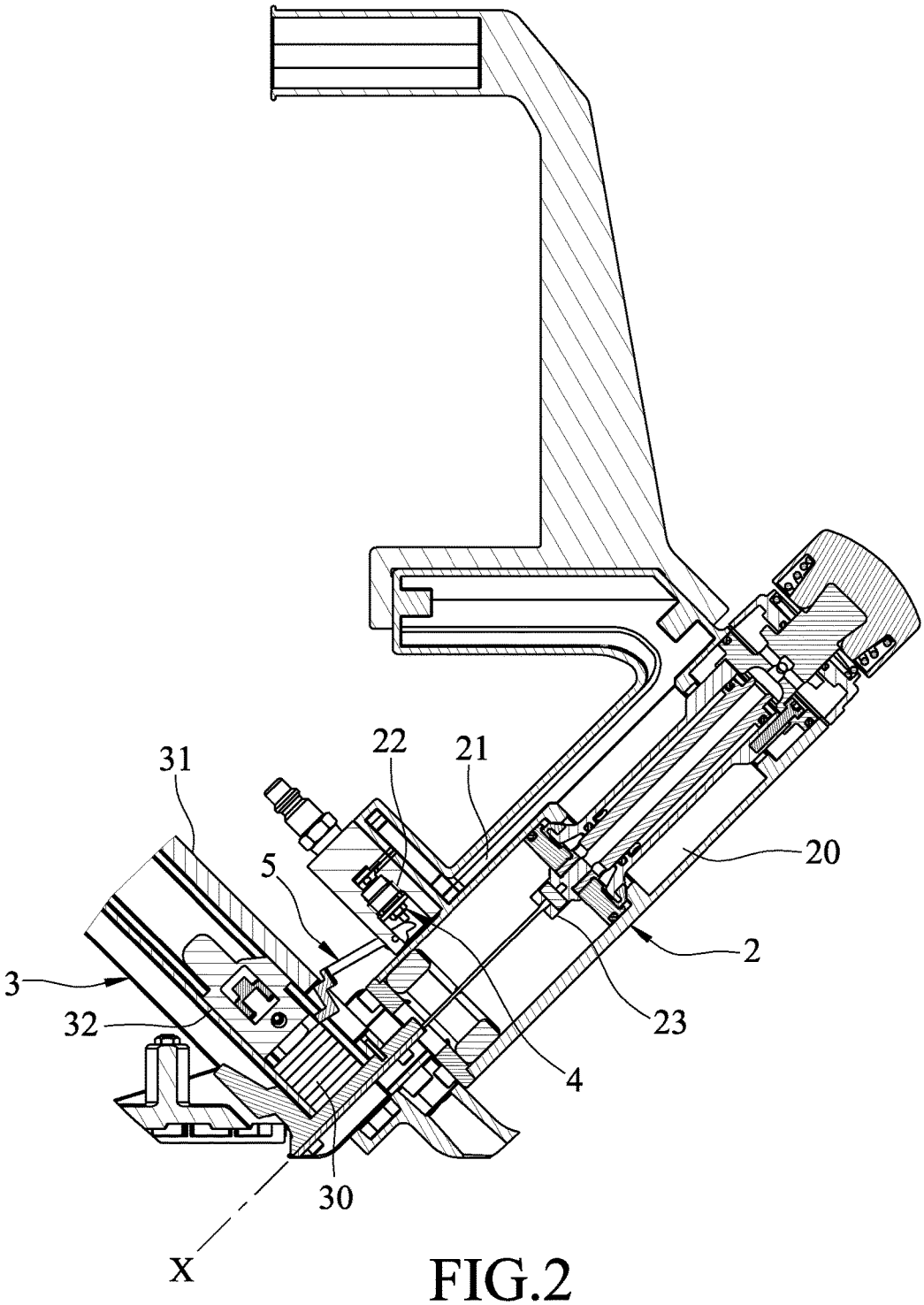
FIG. 2 is a sectional view of a first embodiment of a nail gun according to the invention.
Figure 3:
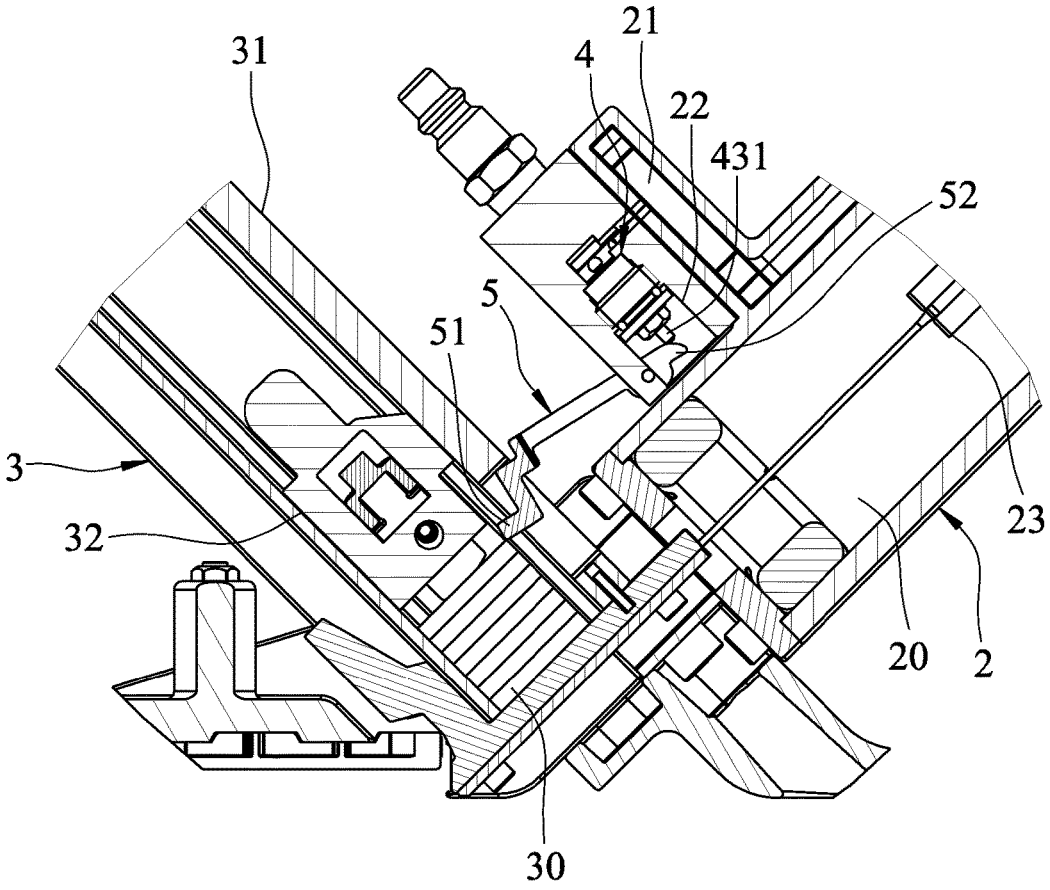
FIG. 3 is a fragmentary sectional view of the first embodiment.
Figure 4:
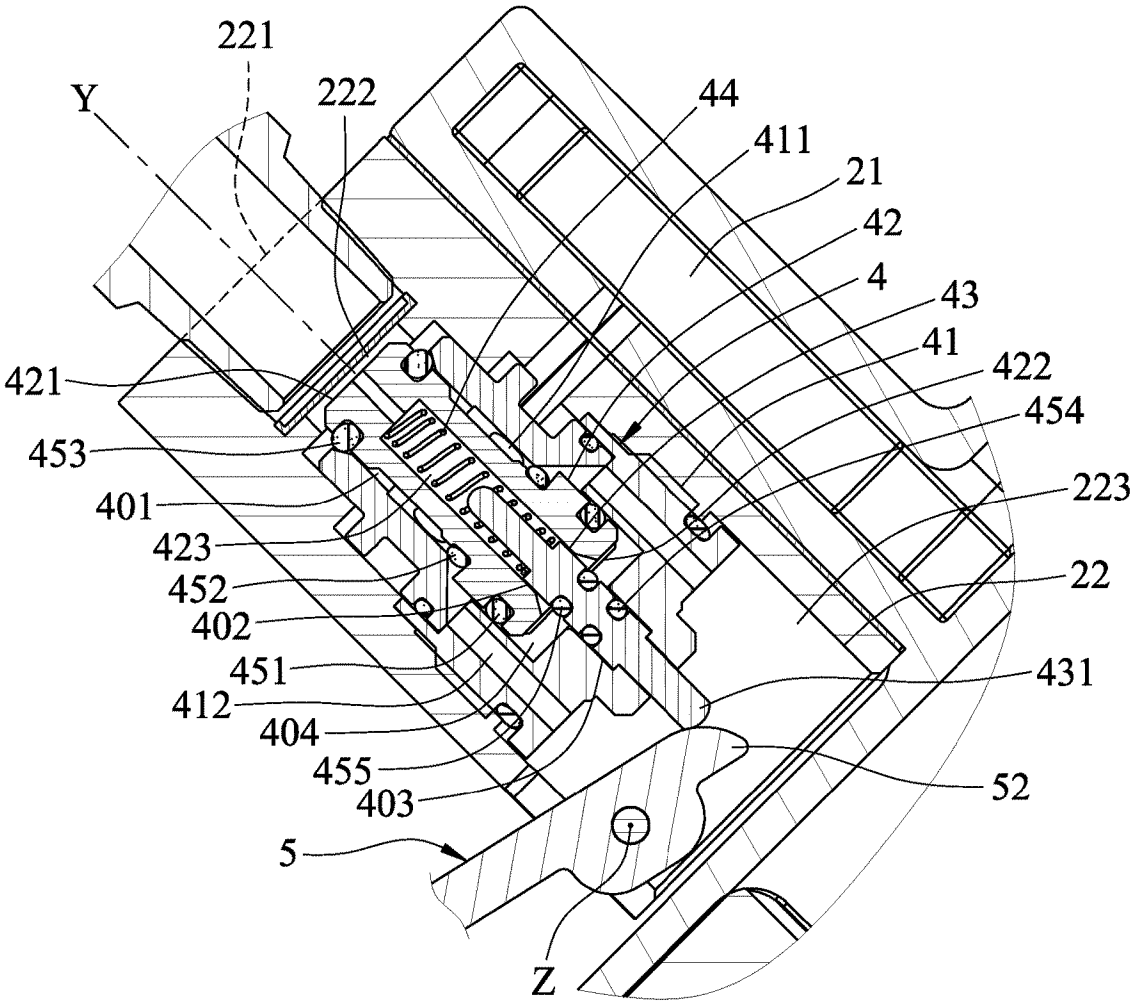
FIG. 4 is another fragmentary sectional view of the first embodiment, illustrating a valve unit in an unblocking state.

As shown in FIGS. 2, 3 and 4, a first embodiment of a nail gun according to the present invention includes a body 2, a nail striking member 23, a magazine 3, a valve unit 4 and a detector 5.

Figure 7:
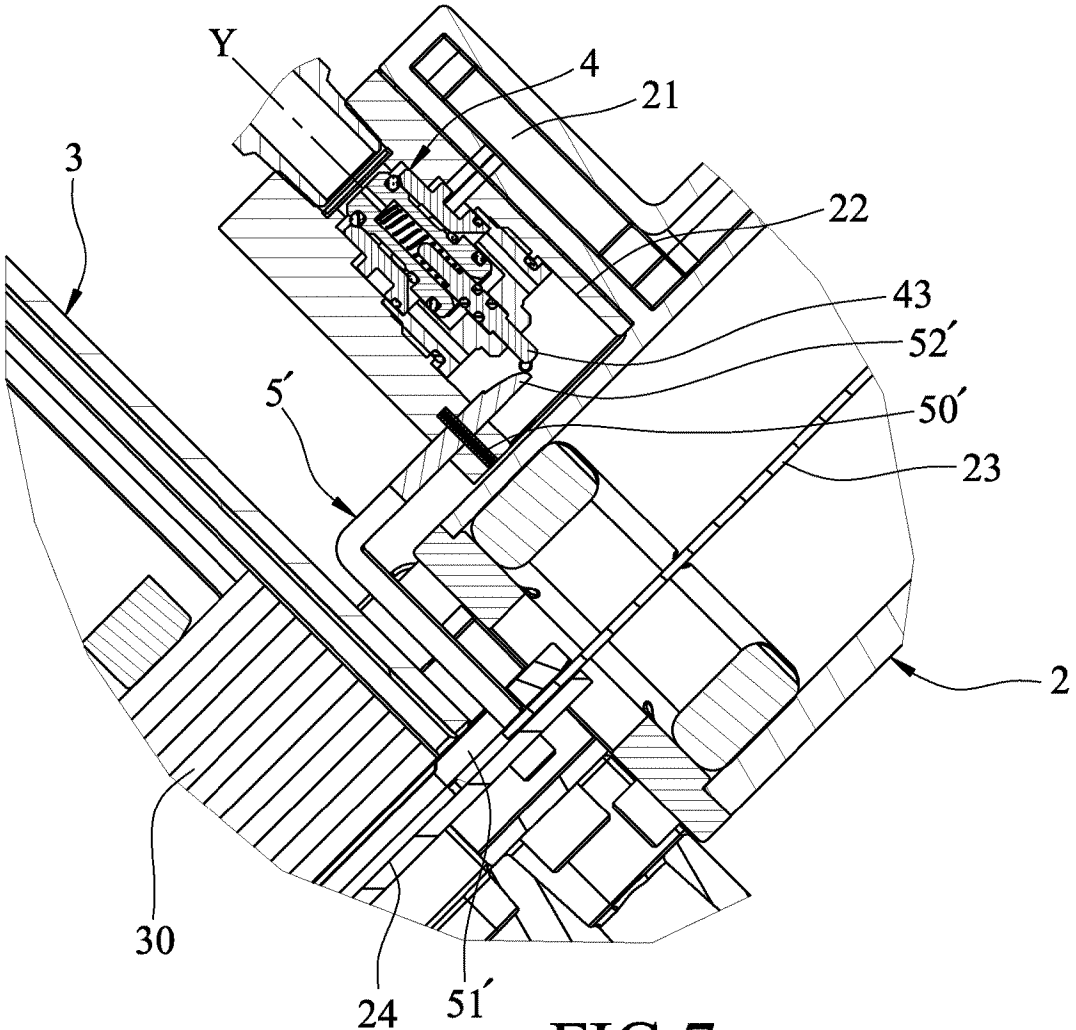
FIG. 7 is a fragmentary sectional view of a second embodiment of the nail gun according to the invention, illustrating a valve unit in an unblocking state.
Figure 8:
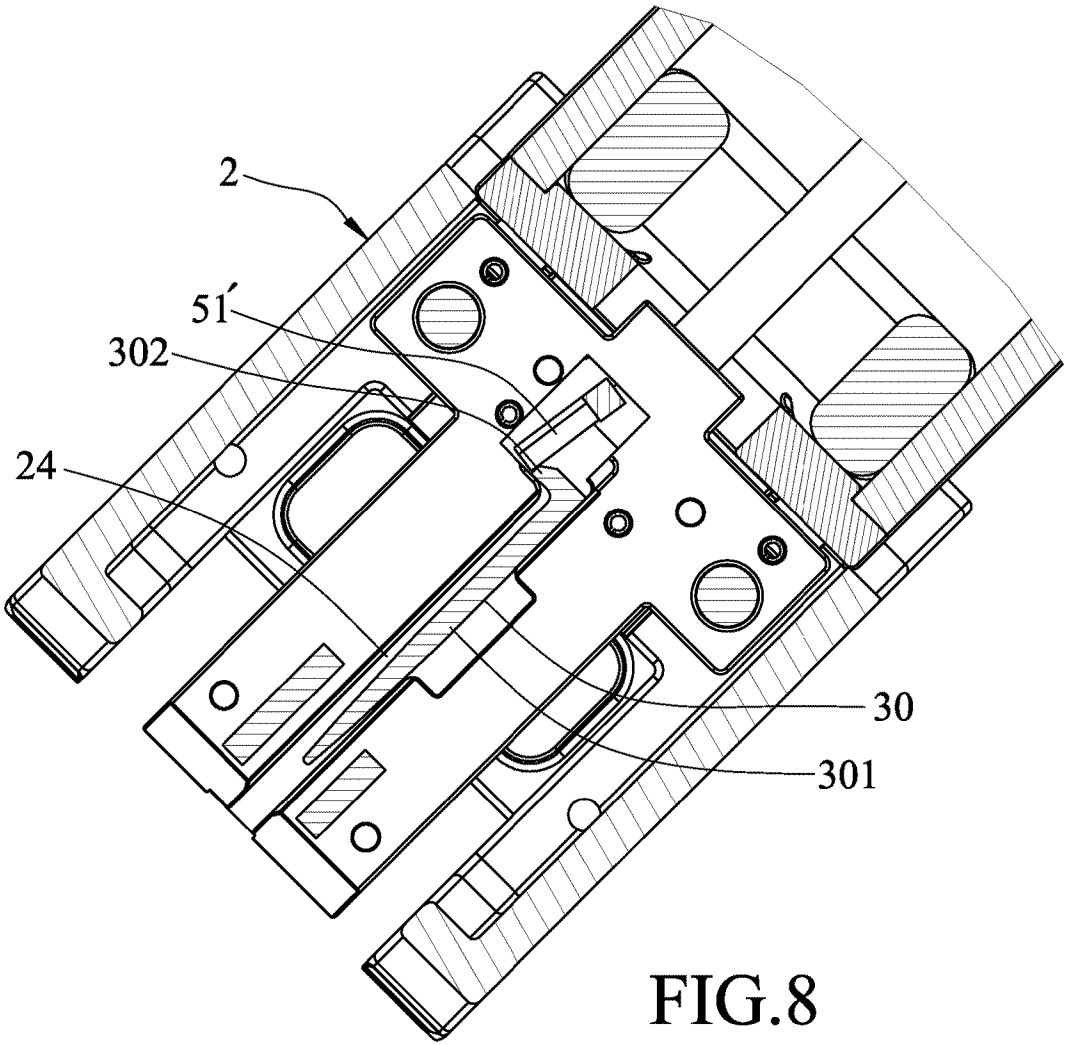
FIG. 8 is another fragmentary sectional view of the second embodiment, illustrating a detector being pushed by a nail.
Figure 9:
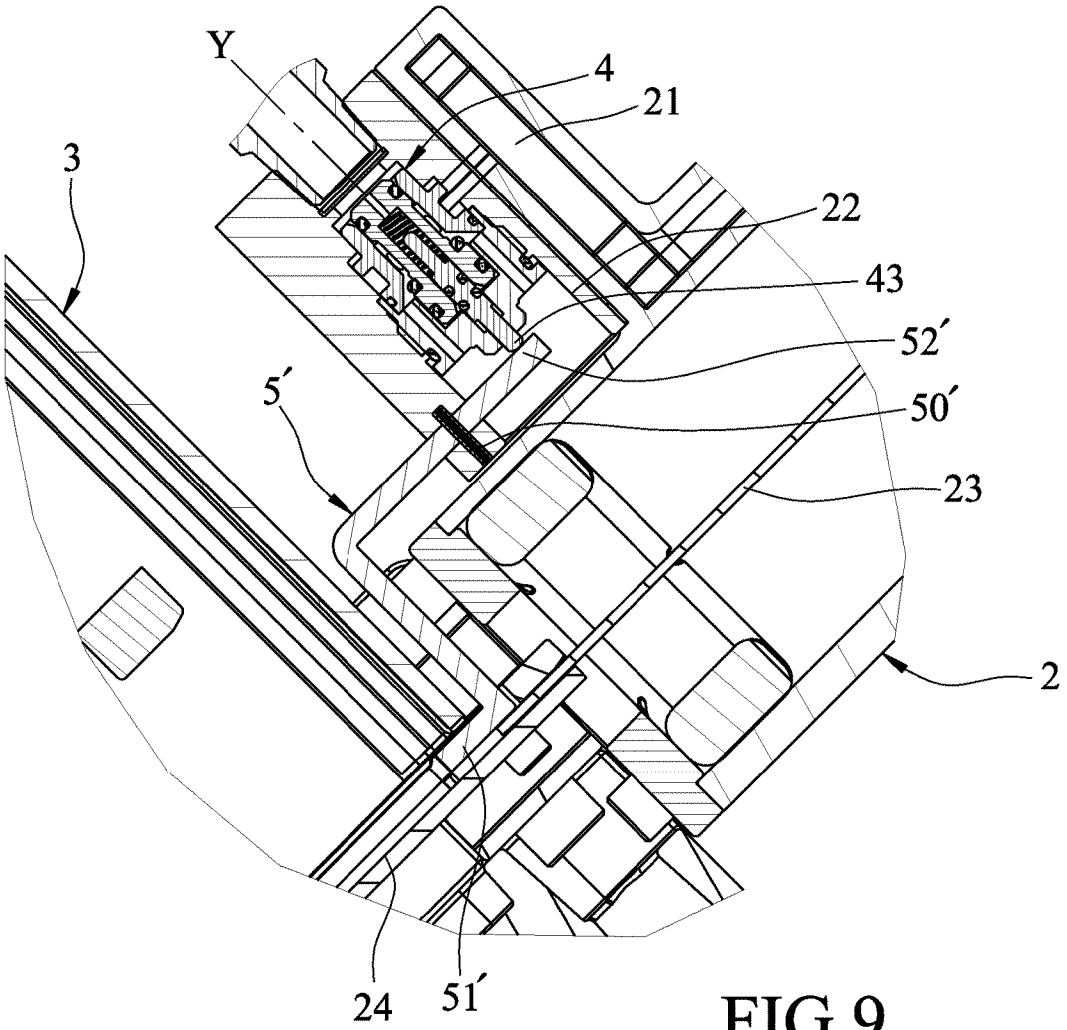
FIG. 9 is still another fragmentary sectional view of the second embodiment, illustrating the valve unit in a blocking state.

The body 2 has an air chamber 20, a main flowpath 21 in fluid communication with the air chamber 20, an air passage 22 guiding flow of air into the main flowpath 21, and a nail path 24 (refer to FIG. 7) formed in a front end portion of the body 2.

The nail striking member 23 has a portion disposed in the nail path 24 of the gun body 2, and is drivable by air pressure in the air chamber 20 to move relative to the body 2 along an X-axis (X) for performing a nail striking operation.

The valve unit 4 is disposed in the air passage 22 and cooperates with the body 2 to divide the air passage 22 into an intake chamber 222 and an exhaust chamber 223. The intake chamber 222 has an inlet opening 221 through which compressed air is fed thereinto. The exhaust chamber 223 communicates fluidly with the outside.

The magazine 3 is connected with the body 2, and includes a magazine body 31 and a nail pushing unit 32. The magazine body 31 receives a plurality of nails 30. The nail pushing unit 32 is movable between upper limit position (see FIG. 5) and a lower limit position (see FIG. 3) for pushing and moving the nails 30 into the nail path 24 one at a time. The upper limit position is proximate to the nail path 24. The lower limit position is distal from the nail path 24.

The valve unit 4 includes a valve seat 41, a valve sleeve 42, a valve rod 43, a first resilient member 44, a first seal member 451, a second seal member 452, a third seal member 453, a fourth seal member 454 and a fifth seal member 455.

The valve seat 41 is disposed fixedly in the air passage 22 between the intake chamber 222 and the exhaust chamber 223, and has a through hole 411 in fluid communication with the main flowpath 21 and the air passage 22, and an auxiliary flowpath 412 disposed between and in fluid communication with the through hole 411 and the exhaust chamber 223.

The valve sleeve 42 extends into the valve seat 41, is movable relative to the valve seat 41 along a Y-axis (Y), and cooperates with the valve seat 41 to form a first air gap 401 therebetween that is in fluid communication with the through hole 411 and the air passage 22. The valve sleeve 42 has a first end surface 421, a second end surface 422 that is opposite to the first end surface 421 and that faces toward an inner surface of the valve seat 41, and a hole 423 that extends through the first and second end surfaces 421, 422 along the Y-axis (Y), and that is in fluid communication with the intake chamber 222. The second end surface 422 has a surface area greater than that of the first end surface 421.

The valve rod 43 extends into the valve seat 41 and the valve sleeve 42 to forma second air gap 402 between the valve rod 43 and the valve sleeve 42 and a third air gap 403 between the valve rod 43 and the valve seat 41, and is movable relative to the valve seat 41 and the valve sleeve 42 along the Y-axis (Y). The valve rod 43 and the valve sleeve 42 cooperatively form a valve rod assembly. An end of the valve sleeve 42 extends into the intake chamber 222. An end 431 of the valve rod 43 extends through the valve seat 41 into the exhaust chamber 223.

The first resilient member 44 is disposed between the valve sleeve 42 and the valve rod 43 for biasing resiliently the valve sleeve 42 and the valve rod 43 away from each other.

The first, second and third seal members 451, 452, 453 are disposed between the valve seat 41 and the valve sleeve 42. The first seal member 451 is in sealing contact with the valve seat 41 to define an air pressure space 404 disposed between the second end surface 422 of the valve sleeve 42 and the valve seat 41 and in fluid communication with the hole 423 and the second air gap 402.

The fourth and fifth sealing members 454, 455 are disposed between the valve rod 43 and the valve sleeve 42.

The detector 5 has a detecting portion 51, a control portion 52, and an intermediate portion disposed between the detecting portion 51 and the control portion 52 and connected pivotally to the body 2 such that the detecting portion 51 and the control portion 52 is rotatable relative to the body 2 in opposite directions about a Z-axis (Z). The control portion 52 extends into the exhaust chamber 223. The end 431 of the valve rod 43 is biased by the first resilient member 44 to contact the control portion 52. The detecting portion 51 extends into the magazine 3, and is disposed on a moving path of the nail pushing unit 32.

Referring to FIGS. 3 and 4, when the nails 30 are received in the magazine body 31 of the magazine 3, the nail pushing unit 32 is spaced apart from the upper limit position and the detecting portion 51 of the detector 5. At this time, the valve rod 43 is biased by the first resilient member 44 to move toward the exhaust chamber 223 to move the fourth seal member 454 into sealing contact with the valve rod 43 and the valve seat 41, and to remove the fifth seal member 455 from an inner surface of the valve sleeve 42, so as to permit fluid communication between the hole 423 and the air pressure space 404 via the second air gap 402, while preventing fluid communication between the air pressure space 404 and the exhaust chamber 223. The compressed air in the intake chamber 222 therefore flows into the air pressure space 404 via the hole 423. Since the second end surface 422 has a surface area greater than that of the first end surface 421, the resultant force applied on the second end surface 422 is greater than the resultant force applied on the first end surface 421, and the valve sleeve 42 is therefore moved toward the intake chamber 222 to move the second seal member 452 into sealing contact with the valve seat 41 and the valve sleeve 42, and to remove the third seal member 453 from the valve seat 41, so as to prevent fluid communication between the first air gap 401 and the auxiliary flowpath 412, while permitting fluid communication between the intake chamber 222 and the first air gap 401 to switch the valve unit 4 to an unblocking state. As a result, the compressed air in the intake chamber 222 can flow through the first air gap 401, the through hole 411 and the main flowpath 21 into the air chamber 20 for driving the nail striking member 23 to perform the nail striking operation.

Figure 5:
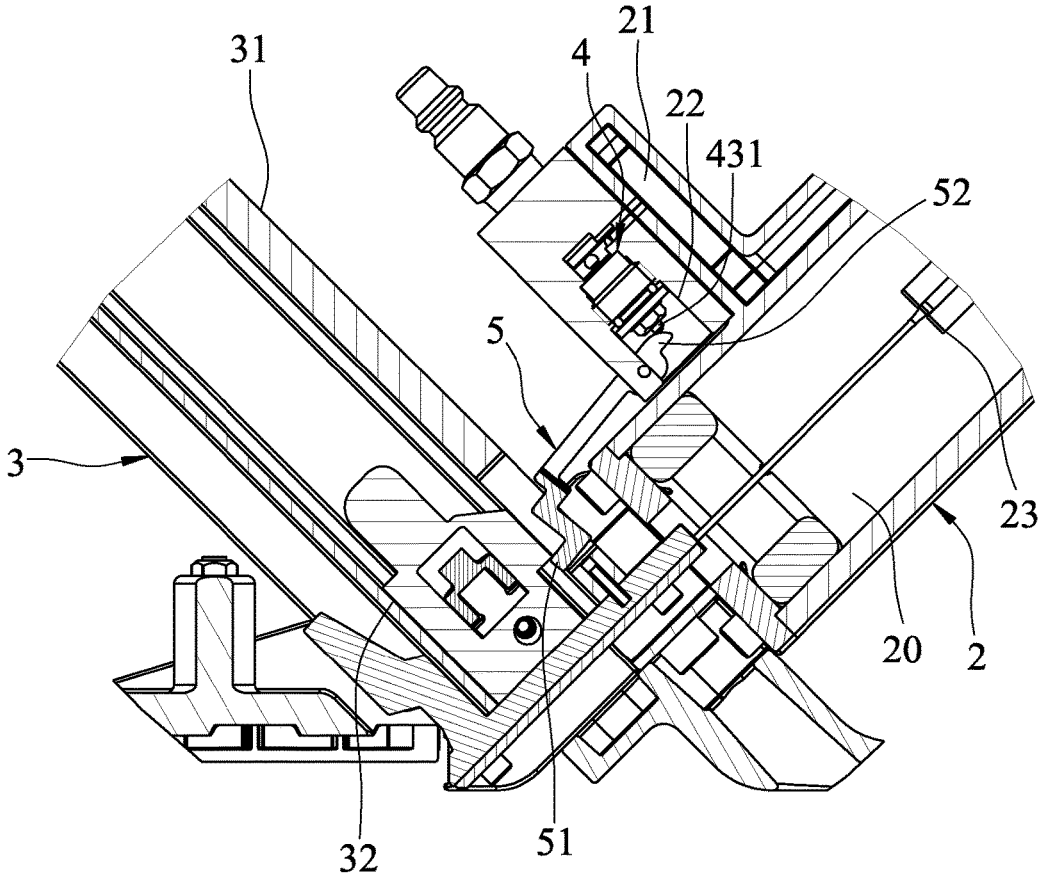
FIG. 5 is still another fragmentary sectional view of the first embodiment similar to FIG. 3 but illustrating how the valve unit is converted from the unblocking state to a blocking state under control of a control portion of a detector.
Figure 6:
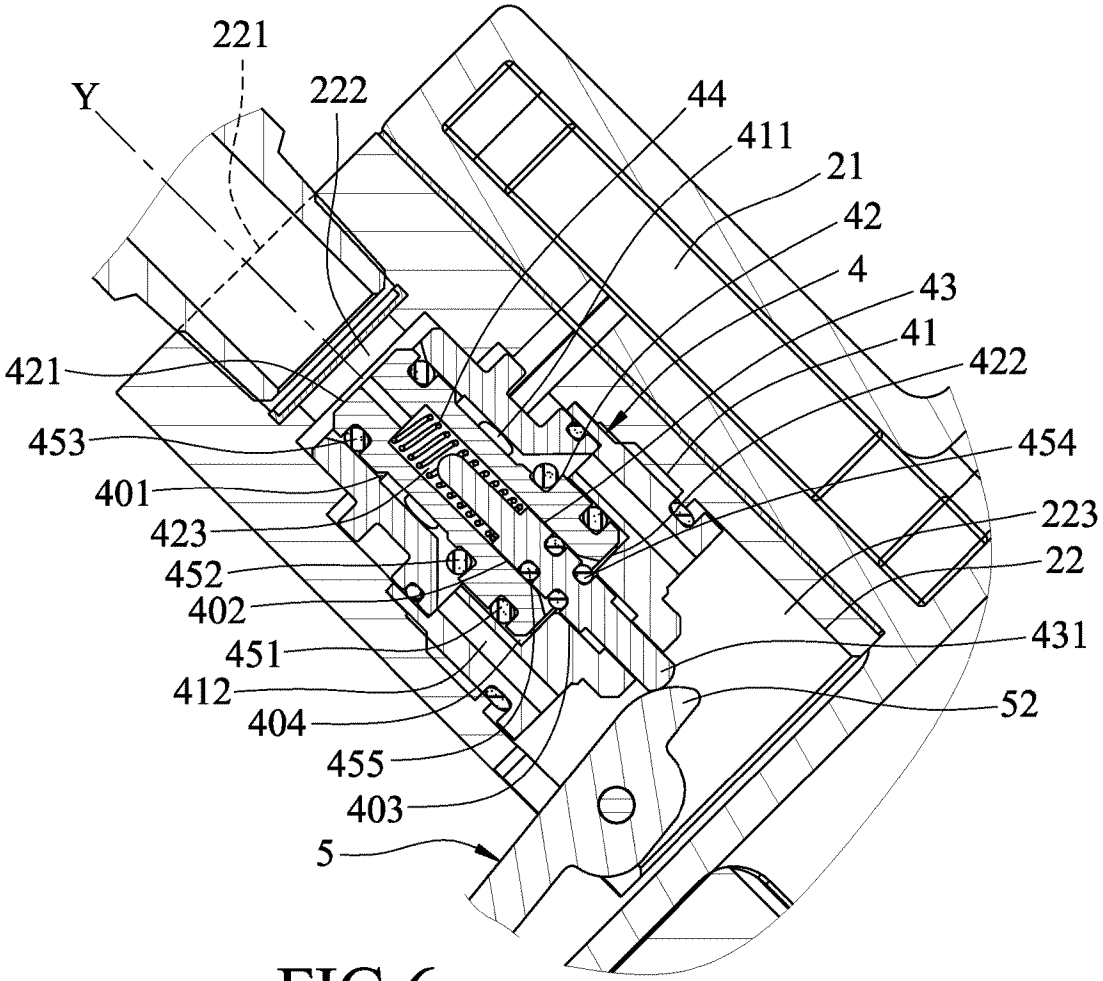
FIG. 6 is still another fragmentary sectional view of the first embodiment, illustrating the valve unit in the blocking state.

Referring to FIGS. 5 and 6, when the last one of the nails 30 is struck out of the nail path 24, the nail pushing unit 32 moves to the upper limit position to push the detecting portion 51 of the detector 5 to rotate, so as to press the control portion 52 against the end 431 of the valve rod 43. At this time, the valve rod 43 is driven by the control portion 52 to move away from the exhaust chamber 223 against the biasing force of the first resilient member 44 to remove the fourth seal member 454 from the inner surface of the valve seat 41, and to move the fifth seal member 455 into sealing contact with the valve rod 43 and the valve sleeve 42, so as to prevent the fluid communication between the hole 423 and the air pressure space 404 via the second air gap 402, while permitting the fluid communication between the air pressure space 404 and the exhaust chamber 223. The compressed air in the intake chamber 222 is therefore prevented from flowing into the air pressure space 404, and generates a resultant force applied on the first end surface 421 to drive the valve sleeve 42 to move toward the exhaust chamber 223 to remove the second seal member 452 from the inner surface of the valve seat 41, and to move the third seal member 453 into sealing contact with the valve sleeve 42 and the valve seat 41, so as to permit the fluid communication between the first air gap 401 and the auxiliary flowpath 412, while preventing the fluid communication between the intake chamber 222 and the first air gap 401 to switch the valve unit 4 to a blocking state. As a result, the compressed air in the air chamber 20 can flow through the main flowpath 21, the through hole 411, the first air gap 401 and the auxiliary flowpath 412 into the exhaust chamber 223 for preventing the nail striking member 23 from performing the nail striking operation. The fluid communication between the air pressure space 404 and the exhaust chamber 223 facilitates the movement of the valve sleeve 42 toward the exhaust chamber 223.

It is noted that in a variation of the first embodiment, there may be at least one of the nails 30 received in the nail path 24 or the magazine body 31 when the nail pushing unit 32 is moved to the upper limit position.

Figure 10:
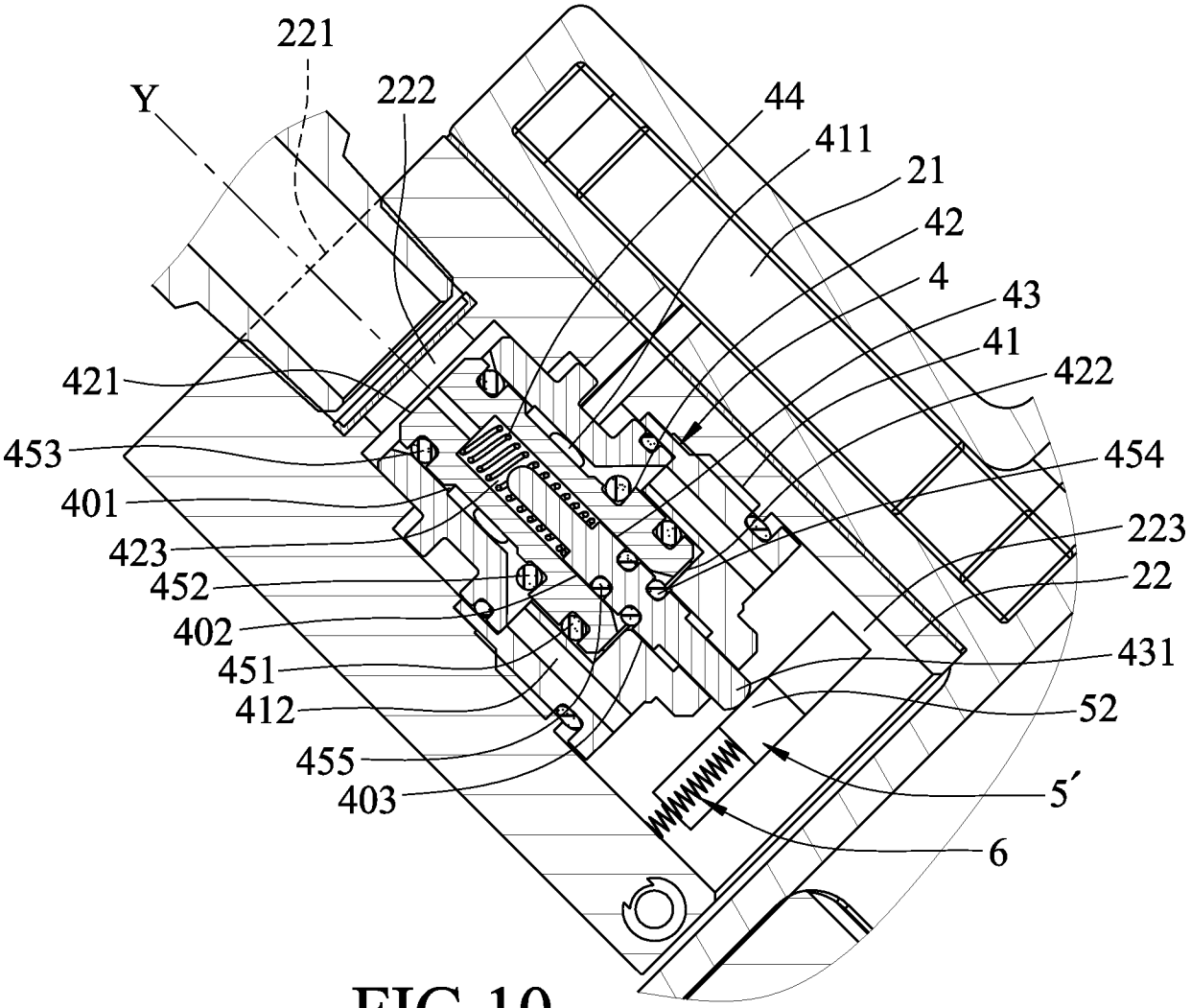
FIG. 10 is yet another fragmentary sectional view of the second embodiment, illustrating the valve unit in the blocking state.

Referring to FIGS. 7 to 10, a second embodiment of the nail gun according to the present invention is similar to the first embodiment, and further includes a second resilient member 6 (see FIG. 10).

Each of the nails 30 has a nail body 301 and a nail head 302 connected to the nail body 301.

The detector 5' of the second embodiment is connected to and pivotable about a pivot shaft 50' that is connected to the body 2 and that extends in the direction of the Y-axis (Y). The detecting portion 51' and the control portion 52' are disposed at opposite sides of the pivot shaft 50', and extend respectively into the nail path 24 and the exhaust chamber 223.

The second resilient member 6 is disposed between the control portion 52' and the body 2 for biasing resiliently the detector 5' to rotate in a direction to move the control portion 52' to contact the end 431 of the valve rod 43.

When one of the nails 30 is moved into the nail path 24, the detecting portion 51' of the detector 5' is pushed by the nail head 302 of the one of the nails 30 to allow the detector 5' to rotate in an opposite direction against biasing action of the second resilient member 6 to thereby remove the control portion 52' from the end 431 of the valve rod 43, so as to switch the valve unit 4 to the unblocking state to permit the fluid communication between the intake chamber 222 and the air chamber 20.

When there is no nail in the nail path 24, the control portion 52' is biased by the second resilient member 6 to rotate to contact the end 431 of the valve rod 43, so as to switch the valve unit 4 to the blocking state to prevent the fluid communication between the intake chamber 222 and the air chamber 20, and to prevent the nail striking action of the nail striking member 23.

To sum up, since the detector 5, 5' automatically switch the valve unit 4 to the blocking state to prevent nail striking action of the nail striking member 23 when there is no nail in the nail path 24, the nail gun of the invention is prevented from dry firing. A user is easily aware that there is no nail 30 in the nail gun when the nail gun cannot perform the nail striking action.

While the present invention has been described in connection with what are considered the most practical embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A nail gun comprising:

a body having a nail path formed in a front end portion thereof, an air chamber, a main flowpath in fluid communication with said air chamber, and an air passage guiding flow of air into said main flowpath;

a nail striking member disposed in said nail path and drivable by air pressure in said air chamber to move along an X-axis for performing a nail striking operation;

a magazine connected with said body and including a magazine body adapted for receiving a plurality of nails, and a nail pushing unit movable between upper and lower limit positions and adapted for pushing and moving the nails into said nail path one at a time, said upper limit position being proximate to said nail path, said lower limit position being distal from said nail path;

a valve unit disposed in said air passage and cooperating with said body to divide said air passage into an intake chamber and an exhaust chamber that is adapted to be in fluid communication with the outside, said valve unit being in fluid communication with said main flowpath and said air passage and being operable to switch between an unblocking state, where fluid communication between said intake chamber and said air chamber is permitted and where fluid communication between said exhaust chamber and said air chamber is prevented, and a blocking state, where the fluid communication between said intake chamber and said air chamber is prevented and where the fluid communication between said exhaust chamber and said air chamber is permitted; and a detector having a control portion, a detecting portion adapted to be contactable with one of said nail pushing unit and the nails, and an intermediate portion disposed between said control portion and said detecting portion and connected pivotally to said body, said control portion extending into said exhaust chamber and being contactable with said valve unit such that, when there is not any of the nails in said nail path, or when said nail pushing unit is moved to said upper limit position, said valve unit is controlled by said control portion of said detector to be in said blocking state.

2. The nail gun as claimed in claim 1, wherein said detecting portion of said detector extends into said magazine, and is pushed by said nail pushing unit to rotate so as to press said control portion against a portion of said valve unit to thereby switch said valve unit to said blocking state when said nail pushing unit is moved to said upper limit position.

3. The nail gun as claimed in claim 1, each of the nails having a nail body and a nail head connected to the nail body, wherein said nail gun further comprises a resilient member disposed between said control portion of said detector and said body for biasing said detector to rotate in a direction to move said control portion to contact said valve unit, said detecting portion of said detector being pushed by one of the nails to allow said detector to rotate in an opposite direction against biasing action of said resilient member to thereby remove said control portion from said valve unit so as to switch said valve unit to said unblocking state when the one of the nails is moved into said nail path.

4. The nail gun as claimed in claim 1, wherein said valve unit includes a valve seat disposed fixedly in said air passage and having at least one through hole in fluid communication with said intake chamber of said air passage and said main flowpath, and a valve rod assembly movable in said valve seat to open and close said through hole.

5. The nail gun as claimed in claim 4, wherein said control portion of said detector extends into said exhaust chamber, said valve seat having an auxiliary flowpath disposed between and in fluid communication with said through hole and said exhaust chamber such that, when said valve unit is in said blocking state, air in said air chamber can be discharged through said main flowpath, said through hole, and said exhaust chamber.

6. The nail gun as claimed in claim 5, wherein said valve rod assembly includes a valve sleeve extending movably into said valve seat to form a first air gap therebetween, a valve rod extending movably into said valve sleeve and said valve seat to form a second air gap between said valve rod and said valve sleeve, and a third air gap between said valve rod and said valve seat, and a resilient member disposed between said valve rod and said valve sleeve for biasing said valve rod to contact said control portion of said detector, an end of said valve sleeve extending into said intake chamber and an end of said valve rod extending into said exhaust chamber such that, when said valve unit is in said unblocking state, fluid communication between said first air gap and said auxiliary flowpath is prevented, fluid communication between said intake chamber and said first air gap is permitted, and fluid communication between said intake chamber and said second air gap is permitted; and when said valve unit is in said blocking state, fluid communication between said intake chamber and said first air gap is prevented, fluid communication between said intake chamber and said second air gap is prevented, and fluid communication between said first air gap and said auxiliary flowpath is permitted.

7. The nail gun as claimed in claim 6, wherein said valve sleeve has a first end surface, a second end surface opposite to said first end surface and facing toward an inner surface of said valve seat, and a hole extending through said first and second end surfaces and in fluid communication with said air passage, said second end surface having a surface area greater than that of said first end surface.

8. The nail gun as claimed in claim 7, wherein said valve unit further includes first, second, and third seal members that are disposed between said valve seat and said valve sleeve, said first seal member being in sealing contact with said valve seat to define an air pressure space disposed between said second end surface and said valve seat and in fluid communication with said hole such that, when said valve unit is in said unblocking state, said second seal member is in sealing contact with said valve sleeve and said valve seat to prevent fluid communication between said first air gap and said auxiliary flowpath, and when said valve unit is in said blocking state, said third seal member is in sealing contact with said valve sleeve and said valve seat to prevent fluid communication between said intake chamber and said first air gap.

9. The nail gun as claimed in claim 7, wherein said valve unit further includes a fourth seal member and a fifth seal member that are disposed between said valve rod and said valve sleeve such that, when said valve unit is in said unblocking state, said fourth seal member is in sealing contact with said valve rod and said valve seat to prevent fluid communication between said air pressure space and said exhaust chamber, and when said valve unit is in said blocking state, said fifth seal member is in sealing contact with said valve rod and said valve sleeve to prevent fluid communication between said air pressure space and said second air gap.

* * * * *